US006036103A

United States Patent [19]

Benest

[11] Patent Number: 6,036,103

[45] Date of Patent: Mar. 14, 2000

[54] AGRICULTURAL SPRAYING SYSTEMS

[75] Inventor: Roger S Benest, St. Lawrence, Jersey, United Kingdom

[73] Assignee: Benest Engineering Limited, St. Lawrence, United Kingdom

[21] Appl. No.: 09/051,963

[22] PCT Filed: Oct. 31, 1996

[86] PCT No.: PCT/GB96/02664

§ 371 Date: Apr. 24, 1998

§ 102(e) Date: Apr. 24, 1998

[87] PCT Pub. No.: WO97/16257

PCT Pub. Date: May 9, 1997

[30] Foreign Application Priority Data

Nov. 1, 1995 [GB] United Kingdom ..... 9522336

[51] Int. Cl.[7] ..... B05B 1/20

[52] U.S. Cl. ..... 239/8; 239/159; 239/417.3; 239/424.5; 239/432

[58] Field of Search ..... 239/1, 8, 159, 239/163, 166, 164, 417.3, 423, 424.5, 432

[56] References Cited

U.S. PATENT DOCUMENTS

| | | | |
|---|---|---|---|
| 2,793,081 | 5/1957 | Tinker . | |
| 3,096,023 | 7/1963 | Thomas . | |
| 3,599,866 | 8/1971 | Bolton | 239/8 |
| 3,793,762 | 2/1974 | Stains | 239/8 |
| 4,179,068 | 12/1979 | Dombrowski . | |
| 4,465,832 | 8/1984 | de Wit et al. . | |
| 4,828,181 | 5/1989 | Singels-Craenen | 239/432 X |
| 4,828,182 | 5/1989 | Haruch . | |
| 4,899,937 | 2/1990 | Haruch . | |
| 4,982,716 | 1/1991 | Takeda et al. | 239/432 X |
| 5,326,030 | 7/1994 | Benest | 239/1 |
| 5,732,885 | 3/1998 | Huffman | 239/432 X |
| 5,848,750 | 12/1998 | Schwab | 239/432 X |

FOREIGN PATENT DOCUMENTS

| | | | |
|---|---|---|---|
| 117472 | 9/1984 | European Pat. Off. | 239/432 |
| 56-146914 | 11/1981 | Japan | 239/432 |
| 1381173 | 3/1988 | U.S.S.R. | 239/432 |
| 952457 | 3/1964 | United Kingdom . | |
| 1058838 | 2/1967 | United Kingdom . | |
| 1378190 | 12/1974 | United Kingdom | F23D 11/38 |

*Primary Examiner*—Kevin Weldon

*Attorney, Agent, or Firm*—McCormick, Paulding & Huber LLP

[57] ABSTRACT

A method and apparatus for droplet generation in agricultural or other spraying comprises supplying air and liquid to a supply chamber having an outlet opening, and entraining the liquid in the air flow for droplet formation. Air and liquid are injected into the supply chamber which has a closed end target wall toward which the liquid is directed in the form of a jet and from which the liquid moves outwards towards the outlet opening for droplet formation. The supply of air and liquid at suitable pressures to the chamber and so that the liquid proceeds with direction change to the outlet causes the droplets formed to have a size particularly suitable for effective coating of plant material, and the momentum provided to the droplets by the air enables controlled direction of the resulting spray mist even at very low liquid volumes per hectare.

27 Claims, 3 Drawing Sheets

AGRICULTURAL SPRAYING SYSTEMS

This application is the National stage of International Application PCT/61396/02664.

FIELD OF THE INVENTION

This invention relates to a method and apparatus applicable to agricultural and horticultural and other spraying systems. The invention is particularly applicable to such spraying systems as disclosed in our prior patents and patent applications relating to boom-type sprayers having droplegs carrying spray nozzles. However, the invention is more widely applicable than to dropleg-type sprayers and is applicable to conventional spray-from-above sprayers likewise, and to lance and other hand-held sprayers for certain applications. An additional application of the invention is in harvesting machines such as potato harvesters for spray-treatment of the harvested crop and in related applications such as the spray-treatment of potatoes coming into or coming out of store.

BACKGROUND OF THE INVENTION

A problem which arises generally in relation to sprayers concerns effective penetration of the crop or other material to be sprayed, by the spray of droplets produced by the sprayer. Conventionally, various forms of spray nozzle are utilised in which a spray of droplets is produced solely by virtue of the energy derived from the supply of liquid under pressure.

However, such conventional arrangements do not achieve the level of crop penetration which can be desired.

Various attempts have been made to improve crop penetration including the use of air flow producing means in association with conventional spray nozzles. However, such an arrangement has been found to be bulky and relatively ineffective.

Attempts have also been made to utilise the effect of electrostatic charges to cause the sprayed droplets to be attracted to the crop material and deposited thereon. These also have been found to be relatively ineffective and have not been widely used.

The use of droplegs to permit crops to be sprayed from a low location generally below the canopy of leaves in the case of crops such as potatoes has been found to improve very substantially the ability to cover the under surfaces of plants, as compared with conventional spraying arrangements in which the droplets are discharged onto the canopy of leaves from above.

A further prior proposal known to the Applicants utilises an air supply in association with a liquid supply. However, the liquid supply is directed via a restrictor onto a baffle plate where primary atomisation occurs before the liquid is mixed with the compressed air. The compressed air then forces the thus-produced droplets through a circular passage onto an inner face of a flood jet. There, secondary atomisation takes place, prior to the spray emerging in a flat fan-shaped pattern. This dual stage atomisation process leads, so it is claimed, to the production of relatively large droplets in which air bubbles are trapped and which, by virtue of their size, are less subject to unwanted spray drift. It has been established that the droplets size thus produced is notably ineffective in effecting crop coverage. In practice, what is particularly wanted is the production of a droplet size similar to that which is produced in atmospheric conditions such as a misty morning in a damp climate overnight whereby the droplets which condense on surfaces such as the external surface of a standing car are of such a size that they have little tendency to roll over the surface, and they therefore stay where they are deposited. In combination with this objective, there is the corresponding need to be able to produce such droplets travelling at a sufficiently high velocity in order to penetrate the crop sufficiently.

Further prior proposals are disclosed in GB 952,457 and GB 1,378,190 and U.S. Pat. No. 4,465,832 and U.S. Pat. No. 4,179,068. These proposals involve systems for the admixture of liquid and air for liquid entrainment and/or droplet formation. The most pertinent of these with respect to the present invention is the latter U.S. Pat. No. '068 specification (assigned to NRDC) which discloses a liquid spray device in which liquid enters a swirl chamber in a generally radially inwardly-directed manner for subsequent onward movement through the open end of the swirl chamber under the action of a gas flow delivered at that open end for subsequent discharge from a spaced opening-see FIG. 2. We have established that a system in which both the airflow and the liquid flow do not proceed via an air-and-liquid supply chamber having a closed end wall or target and one or more associated outlets in the manner of the embodiments of the present invention, cannot achieve the beneficial results of the present invention and the system of this prior disclosure operates in a significantly different manner involving generally axial droplet flow (with respect to the liquid supply direction), as compared with the generally radially or outwardly directed flow of the system of the present invention (or up to 45 degrees on each side thereof). Moreover, the system of this prior U.S. Pat. No. '068 specification operates on the effective principle of the maintenance of droplet size at differing air supply pressures, whereas described embodiments of the present invention operate in a manner such that the droplet size changes with changes in system pressure.

There are disclosed in U.S. Pat. Nos. 4,828,182 and 4,899,937 (assigned to Spraying Systems Co) spray nozzle assemblies which have been marketed for use in agricultural spraying situations. The U.S. Pat. No. '182 specification discloses a spray nozzle assembly that finds particular utility in humidification and evaporative cooling applications in which it is desirable that a spray be discharged in a wide and relatively flat spray pattern, which is there contrasted with many prior air assisted nozzles which discharge with a relatively tight round spray pattern.

The system disclosed facilitates pre-atomization of liquids by means of an insert member which includes an elongated impingement element having a transversely extending circular hole which is struck by the pressurised liquid, to break up same. A pressurised stream of air is admitted to the device and a side surface area defines an impingement surface which deflects and breaks up the airstream and considerable turbulence for pre-atomizing the liquid stream is created, and as a result of the airstream being injected transversely into the longitudinally flowing liquid stream, there is produced a liquid flow in the downstream direction towards an outlet nozzle, in the form of finely divided pre-atomized particles. This preliminarily atomized liquid flow stream is then directed axially through a discharge orifice at the open end of the device and an external deflector flange which is transversely oriented to the line of travel of the liquid, directs same through a final discharge orifice where the pre-atomized droplets are broken into extremely fine liquid particles which are then deflected into a flat, wide spray pattern in a manner which maximises their exposure to the ambient air. A cup-shaped recess is believed to produce pressure waves or acoustic energy which assists in the liquid breakdown. The nozzle assembly has particular utility in humidification and evaporative cooling applications.

The U.S. Pat. No. '937 patent discloses the use of the same nozzle assembly in a manner in which it can be easily removed from the nozzle body to enable the nozzle to be used as an hydraulic nozzle.

Accordingly, it can be seen that these prior U.S. patents contain no disclosure whatever relevant to the concept of providing a chamber to which liquid and air supplies are provided, the liquid supply being in unatomised form, and the chamber having a wall or closed end towards which said air and liquid supplies are directed, and from which chamber the liquid and air supplies are discharged outwardly with respect to the closed end of the chamber through an outlet formed in a chamber side wall and in the form of an air flow with entrained liquid droplets.

There is disclosed in U.S. Pat. No. 5,129,583 (Bailey) an atomizer for discharging a jet of one fluid in another fluid. The atomizer comprises an atomizer head disposed generally in-line with the incoming water supply direction and the head is formed with at least one nozzle hole for discharging the jet through the head and generally forwardly and outwardly. The nozzle hole is profiled to reduce deposition on the atomizer when used for spraying into dust-laden flue gas. The nozzle profile is adapted to reduce turbulence. The general direction of water and air flow through the atomizer is actually lengthwise of the atomizer and onwards through the open atomizer head with the addition of a slightly outward component of movement resulting from the nozzle holes' slightly inclined attitude.

There is disclosed in U.S. Pat. No. 3,096,023 (Thomas) a system for distributing lubricant or oil to chains, gears and other machine parts. The system may be readily used with nearly all types of oils regardless of viscosities and changing temperature and humidity. The system provides a plurality of spaced outlets for application to the machine part which is to receive the lubricant. No data is provided regarding pressures needed to produce the requisite flows. Jet units apply a jet directly onto the bearings to be lubricated, or they may be provided with tube or hose connections to convey such jet to a bearing unit and thus the jet is as narrow as such tube or hose. In the embodiments other than those of FIGS. 4 and 7 the material flow is axial throughout the jet units whereby these themselves are incapable of operating in accordance with the principles of the present invention, while that of FIG. 4 shows a superficial resemblance to the latter but is used in a system whereby it produces narrowly-aimed jets of lubricant or coolant to be pin pointed on defined areas of the chains, gears or other machine parts. In the case where coolant is applied, the objective is to apply a concentrated jet of sufficient liquid volume to produce the requisite coolant effect. This is an inversion of the requirements of the present invention which, in a boom-type spraying machine, seeks to apply a uniform liquid coating of droplets, as disclosed herein, utilising the absolute minimum of liquid per unit area, while applying such coating uniformly to crop areas which can be measured in terms of hectares per unit time, instead of square centimetres per unit time.

Accordingly, there is a considerable need at least in relation to agricultural and horticultural boom type sprayers, for improvements in relation to droplet generation as discussed above, having regard to crop penetration, particle size, and minimisation of water carrying requirements, and an object of the present invention is to provide a method and apparatus offering improvements in relation to one or more of these matters, or generally.

SUMMARY OF THE INVENTION

According to the invention there is provided a method and apparatus applicable to spraying as defined in the accompanying claims.

In an embodiment, a droplet generator is provided comprising an air-and-liquid supply chamber to which both a liquid supply and an air flow supply are connected for supply of air and liquid towards an internal wall or target formed by a closed end of the chamber. The droplet generator further comprises structure defining an edge or boundary of an external outlet from the chamber and the liquid supply means is adapted to supply the liquid to the outlet through the chamber via the closed end of the chamber.

In the embodiment, the air flow supply means and the liquid supply means are adapted in relation to the chamber to supply air and liquid towards the closed chamber end for production of the spray of droplets from the chamber outlet by entrainment of the liquid in the air flow. These features produce several significant benefits. These include a particularly useful mode of droplet formation whereby the droplet size is well adapted to enable the air flow to entrain and carry the droplets into the crop. Thus, firstly the arrangement is capable of producing a suitable or optimum droplet size which is consistent with very low liquid volume requirements while achieving satisfactory or better crop penetration. Moreover, the mode of droplet generation is particularly adapted to enable the droplets to be effectively carried by the air flow in a required direction into the crop, for example from a dropleg.

Accordingly, by providing the general arrangement of air flow and liquid supply means to supply air and liquid towards a wall or generally closed chamber end, and for corresponding outward flow through an outlet with entrainment of liquid in the air flow, the advantage is provided that the flow of air and entrained droplets has the required physical and dynamic characteristics and can be directed in any required direction. Additionally, in a given set of apparatus, considerable flexibility exists in designing the direction and width of the spray output. For example, if it is required to generate a relatively wide and fan-shaped output of spray in a given direction then the apparatus is provided with a series of suitably spaced orifices with suitable directions corresponding to the requisite fan-shaped output. The fact that, for example, six orifices are provided instead of one does not, of itself, increase the liquid volume requirements of the spray head in which the orifices are required. Whereas provision of a corresponding number of conventional spray nozzles would produce a corresponding requirement for six times as much liquid flow to the apparatus as compared with a single nozzle apparatus, this does not apply in the case of the embodiments described below. For a multi-orifice spray head, the same volume of liquid to be sprayed may be supplied and all that is needed in order to produce the required spray pattern is the maintenance to all the orifices of the modest air pressure required for the liquid entrainment and droplet formation steps. In other words, more orifices can be provided at the same volume of liquid supply merely by increasing the air supply.

To put it another way, the embodiments of the present invention enable liquid volume supply to be reduced, at will, to levels very substantially below those required for conventional spray nozzles, provided that the air supply is always sufficient for the required entrainment and droplet formation steps.

Also in the embodiments, the one or more orifices is or are formed in a chamber or gallery to which the liquid is supplied in the form of an unatomised jet directed at a closed end of the chamber which has an associated outlet through which the liquid and air flows supplied to the chamber proceed. It is not known whether some or all of the droplet formation occurs at the closed wall of the chamber, or later in the flow path of the materials through the chamber. Possibly, a surface layer of liquid is produced in the chamber which proceeds to the outlet opening and is formed into droplets at that region.

The relative disposition as between the closed end or wall of the chamber towards which the liquid supply is directed, and the location of the one or more outlet openings is of some importance. Broadly, the outlet opening is located relative to that wall of the chamber so that the direction of material flow from the location of impact of the unatomised jet of liquid towards the outlet is generally outwardly of the chamber. In the embodiment, both the air and liquid supply paths to the chamber are generally axially thereof and lengthwise of the chamber towards its opposite closed end, but it may not be necessary for the air supply direction to be exactly axial. Moreover, the location of the one or more outlets relative to the chamber may be but need not be strictly at the outer periphery of the wall or target at which the liquid supply is directed. Thus, in the FIG. 2 embodiment, the outlets are somewhat axially (of the chamber) offset from that wall, and the arrangement is such that the outlet(s) is or are located so as to enable a smooth and effective flow of materials from the chamber end wall outwardly thereof.

Likewise in the embodiments, the jet or flow of liquid supplied to the chamber is disposed generally symmetrically with respect to two or more orifices formed in the chamber so that each orifice receives a generally equal supply of liquid to its entrainment edge or boundary.

Also in the embodiments, provision is made not only for a generally central and thus even supply of liquid to the chamber in which the entrainment orifices are provided, but also of a relatively even or uniform distribution of air to that chamber and thus to the orifices. For this purpose, there are provided axially-directed air flow ducts or drillings in the conduit leading to the air-and-liquid supply chamber, these ducts or drillings being uniformly distributed around a jet or liquid supply member in the conduit.

Other notable features of the embodiment include the function of the air-supply arrangements to act as a venturi or pump with respect to the liquid supply.

The surface of the wall or target towards which the jet or flow of liquid is supplied to the air-and-liquid supply chamber may be constructed to promote uniform distribution of liquid to the entrainment edge or boundary of the associated orifice or outlet. For example, the surface may have a convex and outwardly broadening form having its apex directed at the source of the jet or flow of liquid, and the form of the convex structure being such as to promote the production of a uniform outward liquid flow to the one or more orifices provided in the chamber. A flat surface may alternatively be provided as shown in FIG. 7. It is also envisaged that a concave surface (as shown in FIG. 2) produces useful results. It has been found that in the absence of a uniform liquid supply to two or more spaced orifices in the chamber, there can be a gravitational effect on the distribution of liquid to those orifices whereby non uniformity of spray production can result.

It will be understood that the invention utilises an approach to droplet formation having some technical common ground with carburettor technology. The air supply provides power in the spray plume to penetrate the crop. Droplet formation may occur, as mentioned above, either at the chamber wall which intercepts the liquid supply and/or in the region of the edge or boundary defining the outlet orifice or orifices of the chamber. It has been observed in tests that the plume of spray produced by the apparatus of the invention includes an inner portion, which may for example be of length about 10 to 20 centimeters, and in this portion of the plume the air and entrained liquid is relatively significantly less visible than in the outer portion of the plume where it assumes the characteristic mist or fog-like form. It is not known what effect gives rise to this change in appearance, which is uncharacteristic of conventional spray nozzles.

An important aspect of the embodiments described below is the relatively low power consumption of the air supply system. Whereas currently available so-called airbag sprayers usually require a power input of the order of 80 kilowatts to the fan, the air supply system of the embodiments described below requires only about 10 to 15 kilowatts for a 12 metre spray boom.

It is to be understood that the orifice or outlet from which the droplets are discharged may be modified in shape with respect to the round profile disclosed below. Among the principal advantages of the described embodiment are the simple construction of the droplet generator and the low tendency for orifice blockage, the highly directional droplet propagation, and the low liquid volumes involved. Moreover, very little lateral dispersal of the droplets occurs away from the main jet thereof, as compared with prior proposals, such as those discussed above, which tend to produce a fogging effect.

By reducing liquid volume requirements, the embodiments substantially reduce the usual sprayer down time which is about 40 per cent of working time which is devoted to refilling the tank. Therefore, approaching 40 per cent more work can be produced. A further factor is that the orifices or outlets from which the droplets emerge no longer need to be at the relatively very small sizes required by liquid spray systems. Thus, orifices of the order of 1 millimetre diameter can be utilised compared with 0.3 millimetres for prior liquid systems. This reduces the occurrence of blockages.

It has been found in practice that the embodiments of the invention are extremely tolerant of changes in the pressure of the liquid supply. Thus, for example, it has been found that the liquid supply pressure can be reduced to a level which is even below that of the air flow supply pressure. Indeed it is apparently the case that the embodiments of the invention do not require a liquid supply in the form of a jet of liquid which must intercept, for example, an end wall of the air-and-liquid supply chamber so as to produce a dynamic effect. On the contrary, it appears to be sufficient for the purposes of the invention that merely a sufficient supply of liquid is provided so that the droplet entrainment process can proceed without any shortfall in the supply of liquid therefor. Accordingly, it is thought likely that in view of this fact the droplet formation and entrainment process may well occur largely in the region of the outlet opening from the chamber, rather than within the chamber as such, although the mechanism might differ somewhat according to the nature and dynamic characteristics of the liquid supply.

In this regard, test work shows that modification of the form of the closed chamber end wall in the embodiment, against which the jet of liquid is projected, does not significantly affect the performance of the apparatus and this also appears to support the likelihood that the droplet entrainment process does not significantly occur within the chamber as such.

Further with regard to the mechanism of the droplet entrainment process, it appears to be an important aspect of the process that the liquid/air flow undergoes a change of direction immediately before or during the droplet entrainment process. Thus, it is clear that the process does not occur effectively in an entrainment chamber in which direct onward axial flow through an outlet orifice is permitted in-line with the general direction of material flow through the chamber, as might be expected from the teaching of the above-discussed prior U.S. patents. The mechanism of this effect is presently unknown. It is also noted that there is apparently what may be termed a venturi or siphon effect in the region of the chamber outlet opening or openings, produced by the airflow and serving to deliver liquid to the edge or boundary of the outlet opening. There is also a similar effect where the air and liquid supplies enter the chamber, the outer air flow producing a venturi effect on the inner liquid flow whereby the required liquid pressure in the liquid supply is reduced.

An important practical aspect of the invention relates to the several inter-related magnitude parameters of the main components of the liquid and air supply system. These parameters include the size of the outlet openings or orifices in the air and liquid supply chamber, the air supply pressure, the liquid supply pressure, and the output of the air compressor which supplies air to the system etc.

Considering first the size of the outlet openings in the air and liquid supply chamber, these may be in the range of 0.5 to 2.0 millimetres in diameter, or openings of a similar area in non-circular shapes. It is found that sizes of less than 0.5 millimetres lead to a significantly reduced throw or travel of the plume of droplets produced by the apparatus. A preferred range of diameters (or sizes for other opening shapes) is from 1.3 to 1.8 millimetres and preferably 1.6 to 1.7 millimetres. These latter larger sizes provide the significant advantage of avoiding the frequent nozzle blockages which are a feature of conventional spraying systems. It is found that droplet size is not greatly affected by outlet opening size, but as such size increases, crop penetration increases due to increased velocity of the droplets caused by higher volume throughput as flow resistance reduces.

So far as air supply pressure is concerned, this relates directly to the capacity of the compressor provided to deliver the air supply. While of course an agricultural tractor usually has ample reserves of power to drive a compressor of very substantial proportions, the cost implications of large compressors render them unattractive and it has been found that air supply pressures in the range of up to 0.6 bar and 0.6 to 1.0 bar (above atmospheric pressure), and preferably between 0.7 and 0.9 bar, are convenient utilising a compressor capable of supplying an output of approximately 142 to 566 litres (5 to 20 cubic feet) of air (measured at such pressure) per spraying head or dropleg, per minute. Usually, an output in the range of 283 to 425 litres (10 to 15 cubic feet) per dropleg per minute will be suitable. It is found that the use of pressures above these quoted ranges leads to the production of droplets envisaged, namely to be propelled towards and to adhere to or coat crop and other surfaces exposed to them. Thus, droplets preferably in the range of 80 to 120 or up to 150 microns in maximum dimension are found to be suitable for these purposes. Larger droplets are used for spraying crops from above (not using droplegs) to reduce spray drift caused by wind. Droplets significantly below 80 microns are found to be too small to adhere effectively to sprayed surfaces.

So far as the pressure of the liquid supply is concerned, the principal requirement is a sufficient supply of liquid to the chamber outlet orifice, without the use of a directly-transmitted jet passing through the centre of the orifice. However, pressures of 0.6 bar (above atmospheric pressure) upwards have been found to be suitable in the described embodiments and pressures of 2.5 and up to 6 bar have been tested and found to produce acceptable results in which the air supply is still able to proceed through the orifice or orifices satisfactorily. It appears that the air supply effectively serves to maintain the central opening or void in each orifice during operation, while droplet entrainment occurs, probably at the edge or boundary of the orifice.

One aspect of the versatility of the system becomes apparent from the use of varying liquid supply pressures. It is found that, while satisfactory droplet production occurs at the higher liquid supply pressures mentioned above, the use of these higher pressures produces significantly greater dosage rates, such as 60 litres or even up to 300 litres of liquid per hectare sprayed. Accordingly, it can be seen that this aspect of the invention permits a method of spraying to be adopted in which the dosage rate is varied according to the local requirements of the crop or other material being sprayed. By use of a variable output liquid supply system, the dosage rate can be significantly varied. Conventional spraying systems are not susceptible to such significant variation in dosage rate merely by changing the liquid supply pressure. It appears that this versatility arises from the use in the present invention of significantly larger outlet orifices than in conventional liquid only spray systems in which the limited outlet size itself prevents significant variation in liquid supply rate, whereas the central air-filled orifices of the present invention can readily accommodate such variation.

It will be apparent from the above that the invention, and notably the embodiments of it described below, provides its own distinct approach to the generation of spray droplets suitable to meet the requirements of agricultural and horticultural spraying requirements, and indeed related requirements outside that field. Prior proposals have, in general terms, been based upon the approach of providing droplet generation systems in which, usually, there is provided a step of preliminary atomisation internally of the droplet generating apparatus, this involving inevitably a corresponding step of liquid-and-air interaction, which is then followed by emergence through a nozzle and lateral deflection using a target or anvil to achieve a further degree of atomisation and droplet generation.

The contrasting approach of the present invention is based upon the use of an internal target or wall within an empty or open chamber to which the air and liquid supplies are delivered. A change of direction of the liquid flow is effected accordingly towards an outlet or orifice which is not directly in-line with the liquid flow through the chamber. The liquid and air flows through the outlet or orifice produce a spray of air-entrained droplets which, at air pressures which are readily determinable, produce droplet sizes suitable for effective coating of plant and other surfaces. There are no internal or external structures to interfere with the through-flow of liquid and air through the orifices. Moreover,it is found that by appropriate choice of outlet opening sizes and dispositions, there can be achieved a direction and degree of crop or other penetration by the spray according to requirements.

The mechanism for droplet generation is not easily determinable without the use of sophisticated equipment.

However, it is apparent from the differences in structure of the droplet generator as between the invention and the prior art that there is a difference of mechanism amounting in simple terms to the use in the present invention of a target or wall followed by an unrestricted outlet orifice, whereas the prior art, generally speaking, uses the inverse arrangement.

Summarising, it is believed that the present invention represents somewhat of a reversal of existing technology in the area of air-facilitation of droplet generation for agricultural and horticultural and related applications, which can benefit from the enhanced generation of the droplets of a size which promotes uniform coating of a substrate utilising minimum volumes of a liquid vehicle for the purpose of diluting an active surface treatment medium. The technique utilises air as a means for replacing the diluting liquid vehicle. The technique is independent to a significant extent of the pressure of the liquid supply. As regards air supply pressure, this is chosen in accordance with the required range of droplet sizes. The range and degree of penetration provided by the plume or jet of spray droplets is determined to a large extent by the size of the outlet openings from the air and liquid supply chamber in combination with the corresponding required volume of air flow at the chosen air supply pressure (the latter being in accordance with droplet size requirements). And, these technical features and advantages are provided by the relatively simple combination of features to be found in the air-and-liquid supply chambers shown in the described embodiments, most notably the provision of a wall or target in the open-centre chamber to which the liquid flow is supplied and which enables, with a change of flow direction, the liquid to reach the requisite number of outlets or orifices in combination with the required air flow through those orifices whereby droplet entrainment occurs in accordance with matters described above. The liquid flow to and through the orifice is generally outwardly of the target or wall and indeed of the chamber, though by no means necessarily in a truly radial direction.

An embodiment of the invention will now be described by way of example with reference to the accompanying drawings in which:

BRIEF DESCRIPTION OF DRAWINGS

FIG. 4 shows a plan view of tractor drawn spraying apparatus incorporating a compressor for supply of air to individual droplegs;

FIG. 5 shows, on a larger scale, a corresponding plan view of an individual dropleg passing between two crop rows and with a direction of a plume or spray of droplets indicated;

FIG. 6 shows an end elevation view of a spray boom of the spraying apparatus of FIG. 4 showing the boom itself and an associated dropleg.

As shown in FIG. 1, a liquid and air supply and connection assembly 10 comprises a machined connection and supply jet member 12 which is a friction fit within the end of a tube member 14.

Tube 14 forms the lower end portion of a dropleg of a dropleg-type sprayer as described in one or more of my prior patents, for example EP 0 600 919 B and EP 0 539 360 B, and as more fully described below with reference to FIGS. 4, 5 and 6 hereof.

Figure 2:
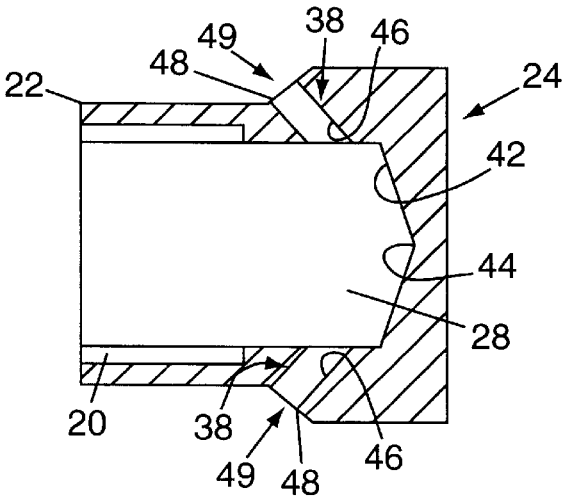
FIG. 2 shows a corresponding longitudinal section through a complementary entrainment chamber adapted to be mounted on the jet and tube assembly.

Jet member 12 is a tight friction fit in tube 14 and has a projecting portion 16 formed with an external screw thread 18 to co-operate with a corresponding internal screw thread 20 provided on the internal surface of a collar portion 22 of an entrainment or chamber member 24—see FIG. 2.

Jet or connection member 12 is formed with a pattern of six axial bores 26 extending lengthwise thereof to deliver air from the pressurised internal volume of dropleg tube 14 to a chamber 28 defined within entrainment or chamber member 24.

Jet or connection member 12 also serves to provide an unatomised jet or flow of liquid into chamber 28, for the purpose to be described. Accordingly the connection member 12 is also provided with a hose sleeve 30 at its inner end, a lengthwise bore 32 leading therefrom, and a jet or supply member 34 to produce an unatomised jet or supply of spray liquid. Jet 34 has its own axial bore 36 which opens into bore 32 and receives liquid therefrom. The lengthwise bore 36 of jet 34 is simply a uniform-section endwise bore with no provision for the generation of droplets in the manner of a spray nozzle.

Thus, summarising the structure and function of jet or connection member 12, it serves to receive spray liquid from a hose which extends lengthwise of the dropleg tube or shank 14 within that tube, and receives also supplies of air pumped lengthwise of that tube in the annular space between the hose and the tube's inner surface. The spray liquid is delivered from jet 34 as a thin uniform stream or supply of liquid. The air is delivered generally uniformly around the periphery of jet member 12 by virtue of the six streams of air produced by bores 26. These flows of liquid and air are delivered to chamber 28 of the entrainment or liquid and air supply chamber member 24.

Turning now to more details of the structure of entrainment or chamber member 24, the principal structural features are its internal form and the provision of orifices or outlets 38 leading outwardly from chamber 28 for the delivery of air and spray liquid from chamber 28. That chamber, 28, is of cylindrical form, comprising an axial bore 40. In this embodiment it is formed with a conical-form end wall 42 with a fairly large cone angle and having an apex 44 at which the jet of liquid from jet 34 is delivered in use.

The orifices 38 are disposed in two groups of three orifices or outlets, making six in all, these groups of three being spaced within the group and between the groups so as to produce two laterally-and-upwardly directed plumes of spray in use from the dropleg tube 14 upwardly and laterally outwardly into the crop in directions in accordance with the teaching contained in my above-mentioned prior patents.

Figure 4:
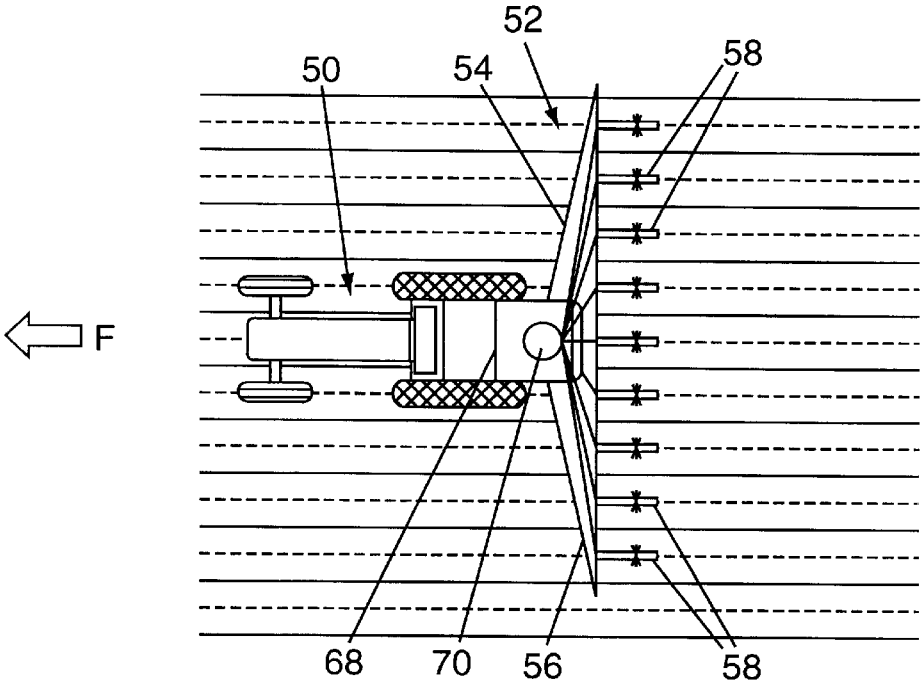
FIGS. 4, 5 and 6 are taken from the present applicants' corresponding published prior International applications including inter alia PCT/GB92/01356 showing tractor-drawn spraying apparatus of the dropleg kind and to which the present invention is applicable.
Figure 5:
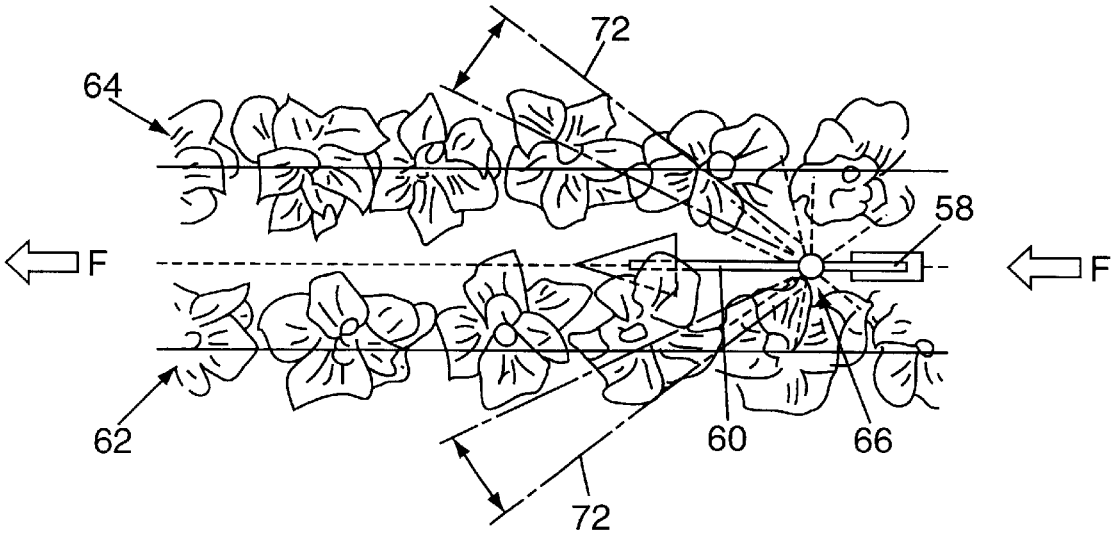
Figure 6:
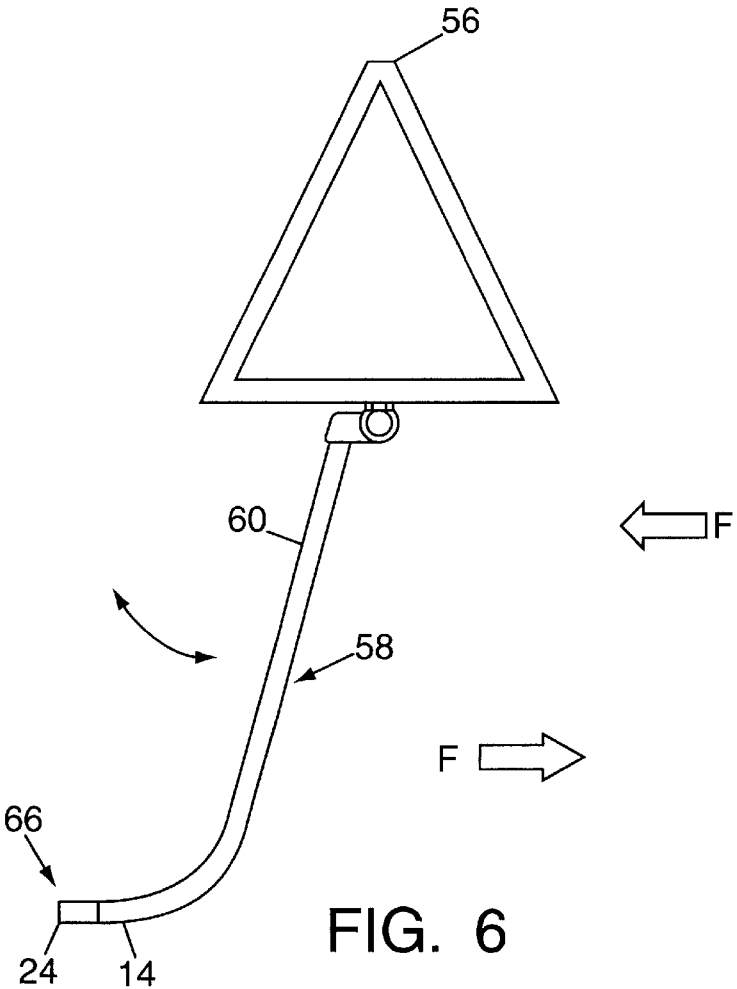

FIGS. 4, 5 and 6 show tractor-drawn spraying apparatus of the kind suitable for incorporation of droplet generation apparatus in accordance with the above-described embodiment of the invention.

Thus, in FIG. 4, a tractor 50 has mounted on the hitch links thereof boom type spraying apparatus 52 comprising spraying booms 54, 56 having associated droplegs 58, as described in our prior published PCT applications.

Each dropleg 58 comprises a downwardly-projecting dropleg shank portion 60 (corresponding to shank 14 in FIG. 1) which enters between crop rows 62, 64 and carries a droplet generator 66 for crop spraying purposes.

Each dropleg 58 has its own droplet generator indicated in FIG. 5 at 66, and this is provided with air and liquid supplies delivering liquid (to be sprayed) and air supplies from the liquid tank 68 and a compressor 70 shown in FIG. 4. The droplet generator 66 produces twin spray jets or plumes 72 (see FIG. 5) directed generally forwardly and upwardly and laterally with respect to the direction F of forward travel of the tractor and the droplegs, and symmetrically with respect to the crop rows. Droplet generator 66 corresponds to the entire apparatus of FIGS. 1, 2 and 3 described above. Such a plume 72 is produced at each side of the dropleg to provide spray treatment of each of the crop rows 62, 64. In FIG. 5, the dropleg 58 shown is constructed as described in our above-mentioned prior PCT applications, whereas in FIG. 6 the dropleg 58 is adapted for the purpose of the present invention to receive both the air and the liquid supplies for transmission of these within the dropleg tube lengthwise thereof to the droplet generator 66 at the lower end thereof, the supplies being delivered thereto as described above and as illustrated in FIG. 1.

In use, liquid and air supplies are delivered to the upper end of each dropleg 58 and thus to its jet or connection member 12 as mentioned above and chamber 28 is pressurised by the air while receiving a jet or supply of liquid on the chamber end wall or target 42 at the apex 44 of the conical form of that end wall. This jet or supply is believed to produce at least a partial film of liquid on the inner surface of the chamber end wall 42 which flows outwardly towards orifices or outlets 38 and passes, likewise as a film, outwardly and lengthwise of the orifice bores 46 to their end edges 48. A degree of droplet formation may occur at the end wall or target 42 of chamber 24.

It is not known exactly what happens at the outer ends of the bores 46, notably at the edges or boundaries of the outlets 49 thereof, except that the result is as described earlier in this application and droplets are formed either in the region of the outlets 49 and/or earlier at the chamber end wall 42, or at a later stage when the air/liquid stream has been sufficiently decelerated by the ambient air.

Figure 1:
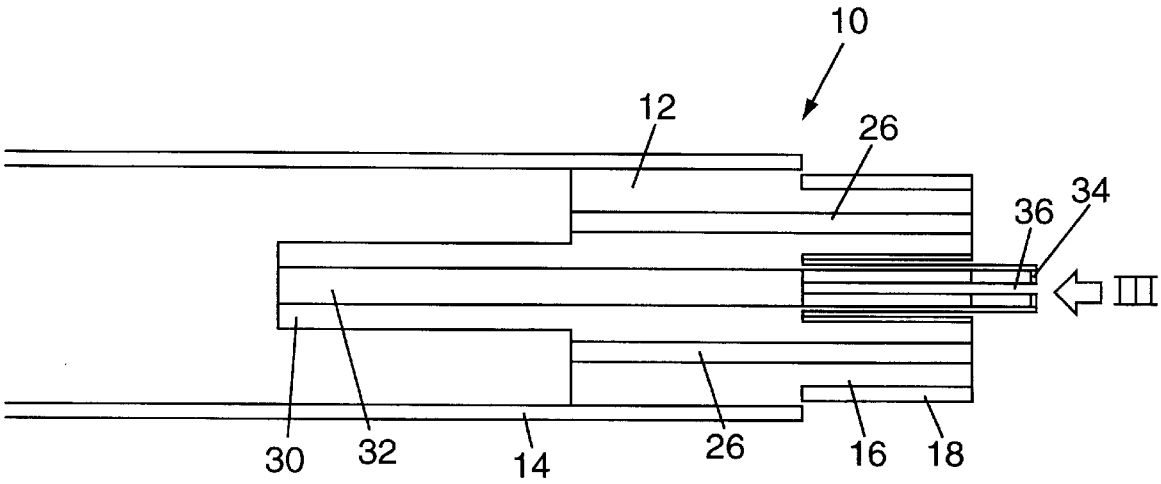
FIG. 1 shows an axial section through a jet and tube assembly.
Figure 3:
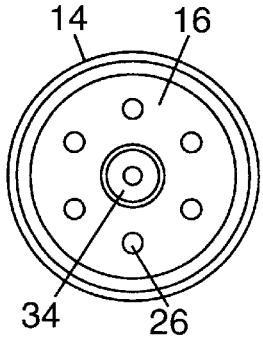
FIG. 3 is an end elevation view of the jet and tube assembly as viewed in the direction III in FIG. 1.

In the embodiment of FIG. 6, the droplet generator 66 of the droplegs 58 of FIG. 6 is, instead of the In the embodiment of FIG. 6, the droplet generator 66 of the droplegs 58 of FIG. 6 is, instead of the assembly 10, 24 of FIGS. 1, 2 and 3, constructed as follows. The droplet generator 100 of FIG. 7 comprises a air and liquid supply chamber 102 to which are provided air 104 and liquid 106 supplies, these being provided in the same relative spacial dispositions as in the previous embodiment, for delivery towards the chamber end wall or target 108, which is planar.

The chamber outlets 110 are disposed in two groups comprising generally forwardly-directed outlets 112 and generally rearwardly-directed outlets 114, with respect to the direction F of normal forward motion of the sprayer.

Figure 7:
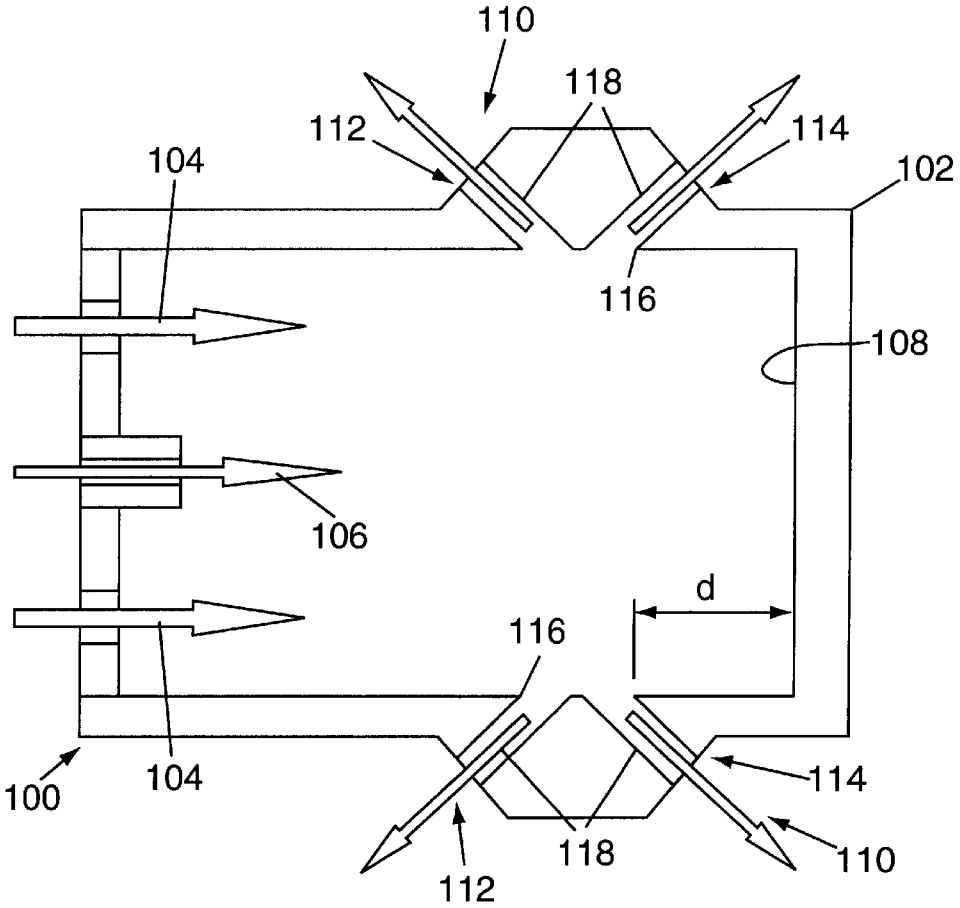
FIG. 7 shows, on a larger scale, a droplet generation or entrainment chamber representing a second embodiment of same and incorporating angularly inclined outlet openings to produce simultaneous jets or plumes of spray droplets in the indicated inclined directions.

As FIG. 7 clearly shows, the entrances 116 to the oulets are disposed so that liquid passing to the bores 118 of the outlets from the end wall 108 must change in direction before entering the bores. Moreover, the entrances 116 are offset from the end wall 108 by a distance d in the axial or liquid flow direction of chamber 102.

This embodiment of the invention is able to discharge spray droplets simultaneously in the two indicated directions which is of benefit for certain agricultural operations.

Broadly speaking, in at least some embodiments of the invention the use of the flow of air to cause movement of the spray of liquid droplets has the effect of replacing the water or similar diluent vehicle conventionally used for spraying purposes, whereby it becomes possible to spray treat agricultural or horticultural or industrial or other objects with a liquid treatment medium without the need for the use of any liquid as a diluent or carrier medium, or at least to reduce the effective volume of such a liquid vehicle by a factor of 10 or more. sprayed is chosen in accordance with the desired size of the droplet to be generated. In an envisaged embodiment, the liquid vehicle for the treatment material may be non-aqueous, for example the liquid vehicle may be an oil-based liquid comprising an aromatic hydrocarbon. It is envisaged that the liquid vehicle which forms part of the liquid to be sprayed will be chosen in accordance not only with the nature of the active chemical ingredient involved, but also in relation to the surface tension and other characteristics of the liquid to be sprayed, these being chosen in order to achieve a desired degree of adhesion to plant surfaces, or related requirements. An example of a related requirement may be the requirement for the sprayed material to be rain-resistant.

Accordingly, in accordance with this embodiment of the invention it can be seen that the invention offers the additional advantage of permitting non-aqueous based liquid vehicles to be offered for spraying purposes whereas such a basis for spraying operation has hitherto been considered commercially unacceptable in view of the relatively high cost of the liquid vehicle due to its volumetric requirements as determined by prior art spraying apparatus.

A further aspect of the present invention relates to the relative importance of providing an ability to inject or otherwise deliver the liquid to be sprayed to the delivery system close to the spraying nozzles on the boom. In this way, the lengths of spraying lines in which relatively concentrated chemicals are transmitted are reduced. This leads to significant advantages in terms of ability to switch from one spraying medium to another at relatively short notice.

Amongst other modifications which could be made in the above embodiments while remaining within the scope of the invention are the following. Firstly, the actual cross sectional shape and dimensions of the air and liquid supply chamber may be varied. A non cylindrical chamber may be used and its axial length in the liquid flow direction may be varied, as indicated by comparison of FIGS. 2 and 7. Routine test work by a competent technical person in the field will reveal the applicable limits. Likewise, variations in the dispositions of the outlets relative to the chamber end wall can be accommodated and provided. The wall or target towards which the liquid supply flows can itself be modified considerably in terms of its profile being planar, generally convex or generally concave. Indeed, the target may be provided as an internal construction in the chamber providing for suitable liquid flow outwards to the chamber outlets. Routine test work will reveal the modifications which may be made in this regard.

It is envisaged that satisfactory results may be obtainable where the air inlet to the chamber is located, for example, at the opposite end from the liquid inlet, or indeed in a side wall of the chamber. Tests have been made of a liquid and air delivery system to the chamber permitting, effectively, a gravity feed to the chamber end wall or target, and thus without the controlled metering of liquid supply to that structure. This arrangement could be adopted where attitude changes are not of significance, but generally it is desirable to provide metering means for delivering an even supply of liquid to the chamber end wall or target. Such may be achieved in a variety of ways additional to the jet or flow indicated in the described embodiments, including the use of several such jets or flows within the chamber. It will be understood from the foregoing description that the chamber end wall or target provides a function of a distribution baffle or member serving to supply an appropriate flow of liquid to the chamber outlets for droplet entrainment.

I claim:

1. Mobile agricultural boom type spraying apparatus comprising:

a) a mobile spraying boom adapted to be caused to pass lengthwise of multiple crop rows while overlying said multiple rows during spraying;

b) said boom carrying multiple droplet generators adapted to generate liquid droplets to effect simultaneous crop spraying of said multiple crop rows as said boom overlies said rows;

c) said droplet generators being adapted to generate multiple droplet sprays capable of traversing the distance between said multiple droplet generators carried by said boom and said crop located below said boom as said boom is caused to travel over said crop, and each droplet generator being capable also of producing its own diverging spray jet adapted to effect spray coverage of its own adjacent portion of said crop so that said crop below said boom is appropriately sprayed;

d) each droplet generator being connected to liquid supply means adapted to supply a liquid to be sprayed;

e) each droplet generator being connected to air flow supply means adapted to supply a flow of air to emerge with a spray of droplets produced by the apparatus;

f) each said droplet generator thus being connected to said liquid and air flow supply means and adapted to produce a spray of liquid droplets and air therefrom:

g) said droplet generator comprising a device having a forward internal target wall and to which device both said liquid supply means and said air flow supply means are connected for supply of said air and liquid generally towards said internal wall in the device;

h) said droplet generator further comprising structure defining an external outlet opening from said device and said liquid supply means being adapted to supply said liquid to said external outlet opening through said device via said internal wall of said device, said outlet opening having a cross-sectional area equal to that of a circle having a diameter of 0.5 to 2.0 mm;

i) said air flow supply means and liquid supply means being adapted in relation to said device to supply air and liquid flows aimed in generally parallel first directions extending from said air flow supply means and said liquid supply means towards said internal target wall for production of said spray of droplets and air from said device external outlet opening by entrainment of said liquid in said air flow;

j) the spray of liquid and air from said external outlet opening being fundamentally in a second direction which second direction extends generally laterally outwardly with respect to said first directions;

k) said device defining a chamber having one end to which said liquid supply means is connected and a closed second end opposite to said first end and at which second end said internal target wall is located; and l) said device also defining a chamber side wall extending between said first and second ends of said chamber, which side wall includes said external outlet opening;

m) said external outlet opening being located rearwardly of said target wall and opening inwardly into an open space connecting said external outlet opening to said internal target wall.

2. Agricultural spraying apparatus for distributing droplets of liquid material from a central liquid supply to a point of liquid application comprising:

a) liquid supply means adapted to supply a liquid to be sprayed;

b) air flow supply means adapted to supply a flow of air to emerge with a spray of droplets produced by the apparatus;

c) a droplet generator connected to said liquid and air flow supply means and adapted to produce a spray of liquid droplets therefrom:

d) said droplet generator having an external outlet adapted to allow an outward liquid flow through said outlet from an internal target wall forwardly of the external outlet, of an air and liquid supply chamber to be entrained in an air flow through said external outlet from said air and liquid supply chamber, for droplet formation;

e) said apparatus being in the form of mobile agricultural boom-type spraying apparatus;

f) said spraying apparatus having a mobile spraying boom adapted to be caused to pass lengthwise of multiple crop rows while overlying said multiple rows during spraying;

g) said boom carrying multiple ones of said droplet generators to generate liquid droplets to effect simultaneous crop spraying of said multiple crop rows as said boom overlies said rows; and h) said droplet generators being adapted to generate multiple droplet sprays capable of traversing the distance between said multiple droplet generators carried by said boom and said crop located below said boom as said boom is caused to travel over said crop, and each droplet generator being capable also of producing its own diverging spray jet adapted to effect spray coverage of its own adjacent portion of said crop so that said crop below said boom is appropriately sprayed.

3. Apparatus according to claim 1, wherein:

said supply device also defines an end wall at said first end of said chamber and said liquid supply means and said air flow supply means are connected to said end wall of said chamber to deliver their respective supplies lengthwise of the chamber towards said target wall.

4. Apparatus according to claim 1, wherein:

said liquid supply means is adapted to supply unatomised liquid to said chamber through a jet directed generally axially of said chamber at said target wall of said chamber.

5. Apparatus according to claim 4, wherein:

said jet is directed generally centrally of said chamber and symmetrically with respect to a plurality of outlet openings communicating with said chamber and from which said spray of liquid droplets proceed.

6. Apparatus according to claim 1, wherein:

said air flow supply means is adapted to supply said air flow to said chamber through a group of two or more openings disposed around said liquid supply means to said chamber.

7. Apparatus according to claim 1, wherein:

said outlet opening from said chamber is formed by a bore formed in a wall of said chamber, the entrance to said bore being disposed so as not to receive liquid directly from said jet before said liquid has been deflected by said target wall of said chamber.

8. Apparatus according to claim 7 wherein:

the entrance to said bore is formed in said chamber side wall.

9. Apparatus according to claim 8, wherein:

said entrance to said bore is axially offset with respect to said internal target wall in said chamber towards which said liquid and air flow supplies are directed.

10. Apparatus according to claim 1, wherein:

said chamber outlet opening is disposed so that droplets discharged through said outlet opening travel initially in a direction which extends generally laterally outwardly with respect to said chamber and which is also inclined with respect to an outward radius from the axis alone which said liquid flows toward said target wall.

11. Apparatus according to claim 10 wherein:

said inclination of said outlet opening with respect to said radius is towards said one end of said chamber at which said liquid flow enters the chamber.

12. Apparatus according to claim 10, wherein:

said inclination of said outlet opening with respect to said radius is away from said one end of the chamber at which said liquid flow enters the chamber.

13. Apparatus according to claim 10, wherein:

said chamber has multiple ones of said outlet opening communicating with it, some of which outlet opening are inclined toward and others of which outlet openings are inclined away from said one end wall of said chamber so that the apparatus can simultaneously discharge spray in directions at substantial inclinations with respect to each other.

14. Apparatus according to claim 1, wherein:

said outlet opening is one of a group of outlet openings spaced apart circumferentially around the axis alone which said liquid flows toward said target wall of said chamber.

15. Apparatus according to claim 14, wherein:

said outlet opening is one of at least two groups of outlet opening disposed symmetrically with respect to said liquid flow axis.

16. Agricultural spraying apparatus according to claim 1 and further comprising:

a spray boom and droplegs mounted on said spray boom, said droplet generators being mounted on said droplegs for operation substantially closer to ground level than if mounted on said boom.

17. A method of spraying with mobile agricultural boom type spraying apparatus, said method comprising:

a) providing a mobile spraying boom (54, 56) adapted to be caused to pass lengthwise of multiple crop rows while overlying said multiple rows during spraying;

b) providing said boom with multiple droplet generators adapted to generate liquid droplets and causing same to effect simultaneous crop spraying of said multiple crop rows as said boom overlies said rows;

c) causing said droplet generators to generate multiple air and liquid droplet sprays the liquid droplets of which sprays traverse the distance between said multiple droplet generators carried on said boom and said crop located below said boom as said boom travels over said crop, with each droplet generator also producing its own diverging spray which effects spray coverage of its own adjacent portion of said crop so that said crop below said boom is appropriately sprayed;

d) causing each droplet generator to be supplied with a liquid to be sprayed;

e) causing each droplet generator to be supplied with air at a pressure of up to 1.0 bar above atmospheric pressure by air flow means which supplies a flow of air to emerge with droplets of the liquid as a spray produced by the apparatus;

f) causing said droplet generator, as connected to said liquid and air flow supply means, to produce a spray of liquid droplets and air therefrom with the droplets having a size of 80 to 150 microns;

g) said droplet generator comprising a device having an internal target wall and said method further comprising supplying both said liquid supply and said air flow so that they are delivered generally towards said internal target wall of said device;

h) said droplet generator further comprising structure defining an external outlet from said device, which external outlet is located rearwardly of the target wall, and said method further comprising the step of supplying said liquid to said outlet via said internal target wall of said device;

i) said method further comprising the step of supplying said air and liquid towards said internal target wall for production of said spray from said device external outlet by entrainment of said liquid in droplet form in said air flow, j) said method further comprising the step of causing said spray of liquid droplets and air from said outlet to be directed generally laterally outwardly with respect to the direction in which said air and liquid supplies enter said device for said movement generally towards said internal target wall of said device;

k) providing said device in the form of a means defining a closed chamber having first and second ends, and connecting said liquid supply means to said first chamber end and locating said target wall at said second chamber end;

l) providing said external outlet in a chamber side wall extending between said first and second chamber ends and with a cross-sectional area equal to that of a circle having a diameter of 0.5 to 2.0 mm; and m) causing said outlet to open inwardly into a space which connects said outlet to said internal target wall.

18. A method for distributing droplets of liquid material from a central liquid supply to a point of liquid application using a mobile agricultural spraying apparatus having a spraying boom, said method comprising:

a) supplying a flow of liquid to be distributed;

b) supplying a flow of air;

c) providing a multiple number of droplet generators on the boom with each droplet generator (66) connected to said liquid and air flows and causing each droplet generator to produce liquid droplets discharged therefrom;

d) providing each droplet generator as a structure defining an air-and liquid supply chamber and an outlet from said chamber and supplying air and liquid to said chamber to cause an outward liquid discharge through said outlet from a target wall of said air-and-liquid supply chamber so as to entrain said liquid discharge in air also flowing through said outlet from said chamber, for droplet formation;

e) having said spraying boom carry said multiple number of droplet generators in spaced relation to one another along the length of said boom and causing the boom to pass lengthwise of multiple crop rows while overlying said multiple rows during spraying;

f) causing said droplet generators to generate multiple droplet sprays which traverse the distance between said multiple droplet generators carried by said boom and said crop located below said boom as said boom is caused to travel over said crop; and g) causing each droplet generator also to produce its own diverging spray jet adapted to effect spray coverage of its own adjacent portion of said crop so that said crop below said boom is appropriately sprayed.

19. A method according to claim 17, and including the further step of:

causing said liquid supply mean to direct said liquid toward said target wall of said chamber in the form of a jet of unatomised liquid.

20. A method according to claim 19, and including the further step of:

causing said jet to be directed generally centrally of said chamber and symmetrically with respect to two or more outlets communicating with said chamber and from which said spray of liquid droplets proceeds.

21. A method according to claim 20, including the further step of:

the air and liquid supplies to each droplet generator being delivered thereto through a dropleg and transmitted lengthwise of the dropleg through conduits provided in the dropleg.

22. A method of droplet generation for use in agricultural crop spraying, said method comprising:

providing a droplet generator having a chamber defined by an interior wall arrangement including a target wall, injecting at least one jet of liquid into said chamber, with said jet having a flow axis directed toward said target wall and at its entry into said chamber being spaced from said wall arrangement in directions radially of said jet flow axis so that said chamber surrounds said jet, supplying a flow of air to said chamber at a pressure of up to 1.0 bar above atmospheric pressure, and providing at least one outlet opening in said droplet generator, said outlet opening having a cross-sectional area equal to that of a circle having a diameter of 0.5 to 2.0 mm and having a flow axis non-aligned with said jet flow axis, and said outlet opening extending from said chamber to the environment surrounding said generator for the discharge of liquid and air from said chamber, so that said discharged liquid at least at some point remote from said generator is in the form of droplets having a size of 80 to 150 microns.

23. A droplet generator for agricultural crop spraying purposes, said generator comprising:

structure defining a chamber with a target wall, said chamber defining structure having at least one liquid delivery inlet communicating with said chamber for delivering at least one jet of liquid into said chamber alone a liquid jet axis intersecting said target wall so that immediately upon leaving said liquid inlet said liquid jet is directed towards said target wall, said chamber having an open space forming part of said chamber and surrounding said liquid jet, and means for introducing pressurized air into said chamber, said chamber defining structure also having a plurality of outlet openings associated with said liquid jet and extending between said chamber and the environment surrounding said chamber defining structure for the discharge of liquid and air from said chamber into said environment, each of said outlet openings having a flow axis non-aligned with said liquid jet axis so that the liquid of said liquid jet is required to change direction before reaching said outlet opening, said liquid delivery inlet having a metering means adapted to deliver said liquid jet in a controlled manner to said target wail of said chamber; and said metering means being adapted to deliver, in use, said liquid jet to said target wall at a location disposed generally symmetrically with respect to said plurality of outlet openings communicating with said chamber.

24. A droplet generator according to claim 23, wherein:

said metering means is adapted to produce a liquid film on said target wall for flowing movement to said plurality of outlet openings.

25. A droplet generator according to claim 24, wherein:

said chamber defining structure has an air inlet for said pressurized air, which air inlet is located generally at the same location in said chamber as said liquid inlet.

26. Agricultural crop spraying apparatus comprising:

at least one droplet generator; and a means for moving said droplet generator relative to a crop to bring the droplets generated by said generator into contact with said crop;

said droplet generator having structure defining a chamber with a target wall, said chamber defining structure having at least one liquid delivery inlet communicating with said chamber for delivering at least one jet of liquid into said chamber along a liquid jet axis intersecting said target wall so that immediately upon leaving said liquid inlet said liquid jet is directed towards said target wall, said chamber surrounding said liquid jet, and means for introducing pressurized air into said chamber, said chamber defining structure also having at least one outlet opening associated with said liquid jet and extending between said chamber and the environment surrounding said chamber defining structure for the discharge of liquid and air from said chamber into said environment, said outlet opening having a flow axis non-aligned with said liquid jet axis so that the liquid of said liquid jet is required to change direction before reaching said outlet opening.

27. A method of droplet generation according to claim 22, including the further step of:

selectively varying at least one of the pressure at which said liquid is supplied to said chamber and the pressure at which said air is supplied to said chamber to selectively vary the size of said droplets.

* * * * *